US007883444B1

(12) United States Patent
Wu

(10) Patent No.: US 7,883,444 B1
(45) Date of Patent: Feb. 8, 2011

(54) EXERCISING DEVICE OPERATED BY A MOTOR TO PERFORM A PASSIVE RECIPROCATING MOTION

(75) Inventor: Dong-Her Wu, Changhua Hsien (TW)

(73) Assignee: Twinsonic Enterprise Co., Ltd., Changhua Hsien (TW)

( * ) Notice: Subject to any disclaimer, the term of this patent is extended or adjusted under 35 U.S.C. 154(b) by 0 days.

(21) Appl. No.: 12/759,035

(22) Filed: Apr. 13, 2010

(30) Foreign Application Priority Data

Aug. 24, 2009 (TW) ..... 98215633 U

(51) Int. Cl.
*A63B 71/00* (2006.01)

(52) U.S. Cl. ..... 482/4; 482/1; 482/8; 482/96; 482/142; 482/901

(58) Field of Classification Search ..... 482/1–9, 482/131, 132, 148, 142, 143, 900, 95, 96, 482/902, 907; 434/247
See application file for complete search history.

(56) References Cited

U.S. PATENT DOCUMENTS 6,786,847 B1 * 9/2004 Morgan et al. ..... 482/6
7,556,593 B2 * 7/2009 Sato ..... 482/95
7,597,656 B2 * 10/2009 Trees ..... 482/142

* cited by examiner

*Primary Examiner*—Glenn Richman
(74) *Attorney, Agent, or Firm*—Alan Kamrath; Kamrath & Associates PA

(57) ABSTRACT

An exercising device includes a base, a driving unit and a limit cap. The base has an upper surface provided with two toothed racks, a first contact switch and a second contact switch and a lower surface provided with an antiskid member. The limit cap has an elongate slideway. The driving unit includes a housing, a rotation shaft, a motor, two driven gears, two handgrips, and a control switch. When the driving unit touches the first contact switch or the second contact switch, the motor is controlled to change the rotation direction of the rotation shaft. Thus, the slideway limits the moving direction of the driving unit to prevent the driving unit from being deflected sideward during movement. In addition, the base will not slip from the ground by provision of the antiskid member.

7 Claims, 9 Drawing Sheets

EXERCISING DEVICE OPERATED BY A MOTOR TO PERFORM A PASSIVE RECIPROCATING MOTION

BACKGROUND OF THE INVENTION

1. Field of the Invention

The present invention relates to an exercising device and, more particularly, to a passive exercising device.

2. Description of the Related Art

A conventional exercising device in accordance with the prior art shown in FIGS. 8 and 9 comprises a base 40, a plurality of rollers 42 rotatably mounted on and protruded outward from the base 40, a driving unit 50 mounted on the base 40 and connected with the rollers 42 to move the rollers 42 relative to the base 40, a housing 60 mounted on the base 40 to cover the driving unit 50, and a handle unit 70 mounted on the top of the housing 60 to move in concert with the housing 60. The base 40 has a surface formed with a plurality of receiving holes 41 to receive the rollers 42. The driving unit 50 includes a toothed belt 52 mounted around the rollers 42 to rotate the rollers 42, a driven gear 511 rotatably mounted in the housing 60 and meshing with the toothed belt 52 to rotate the toothed belt 52, a motor 51 mounted in the housing 60 and connected with the driven gear 511 to rotate the driven gear 511, and two idlers 43 rotatably mounted in the housing 60 and abutting an outer wall of the toothed belt 52 to stretch the toothed belt 52. Thus, the toothed belt 52 is pressed between the driven gear 511 and the two idlers 43.

In operation, the driven gear 511 is rotated by the motor 51 to rotate the toothed belt 52 which rotates the rollers 42 so as to move the base 40, the housing 60 and the handle unit 70. When in use, the rollers 42 are placed on the ground so that a user is knelt on the ground with his two hands holding the handle unit 70. Thus, the handle unit 70 is moved with the rollers 42 by operation of the motor 51 so as to perform a reciprocating motion so that the user is passively driven by the handle unit 70 to move forward and backward successively so as to exercise his arms, shoulder, chest and waist efficiently.

However, the toothed belt 52 is subjected to forces from the driven gear 511, the two idlers 43 and the rollers 42 so that the toothed belt 52 easily produces an elastic fatigue during a long-term utilization and is easily deviated or loosened from the driven gear 511 and the rollers 42, thereby affecting the movement of the exercising device. In addition, the sliding friction between the rollers 42 and the ground is not large enough so that the rollers 42 easily slip from the ground, thereby causing danger to the user during movement of the rollers 42.

BRIEF SUMMARY OF THE INVENTION

In accordance with the present invention, there is provided an exercising device, comprising a base, a driving unit mounted on the base, and a limit cap mounted between the base and the driving unit to limit the driving unit onto the base.

The base has an upper surface and a lower surface. The upper surface of the base is provided with two parallel toothed racks, a first contact switch and a second contact switch. Each of the toothed racks has a first end a second end. The first contact switch is disposed between the first ends of the toothed racks. The second contact switch is disposed between the second ends of the toothed racks. The lower surface of the base is provided with an antiskid member. The limit cap is mounted on the upper surface of the base and has a top formed with an elongate slideway to allow a sliding movement of the driving unit.

The driving unit is mounted on the upper surface of the base and includes a housing slidably mounted in and guided by the slideway of the limit cap, a rotation shaft rotatably mounted on the housing and having two opposite ends protruded outward from the housing respectively, a motor mounted in the housing and connected with the rotation shaft to rotate the rotation shaft, two driven gears mounted on and rotated by the two opposite ends of the rotation shaft respectively and meshing with the toothed racks of the base respectively, two handgrips mounted on the housing to move in concert with the housing and protruded outward from the slideway of the limit cap, and a control switch mounted on one of the two handgrips and electrically connected with the motor to turn on/off the motor. Each of the two handgrips of the driving unit is parallel with the rotation shaft of the driving unit.

Thus, when the driving unit touches the first contact switch or the second contact switch of the base, the motor of the driving unit is controlled by the first contact switch or the second contact switch of the base to change a rotation direction of the rotation shaft of the driving unit.

The primary objective of the present invention is to provide an exercising device that is driven and operated by a motor to perform a passive reciprocating motion.

According to the primary objective of the present invention, the slideway of the limit cap can guide and limit the moving direction of the driving unit to prevent the driving unit from being deflected sideward during movement so that the handgrips are moved smoothly and stably to facilitate the user exercising his body.

According to another objective of the present invention, the driven gears engage the toothed racks exactly so that the driving unit is moved on the base smoothly and stably.

According to a further objective of the present invention, the driven gears are supported by the toothed racks, and the driving unit is supported by the base so that the driving unit has a larger strength to bear a larger pressure.

According to a further objective of the present invention, the antiskid member of the base is placed on the ground so that the base will not slip from the ground to ensure the user's safety.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
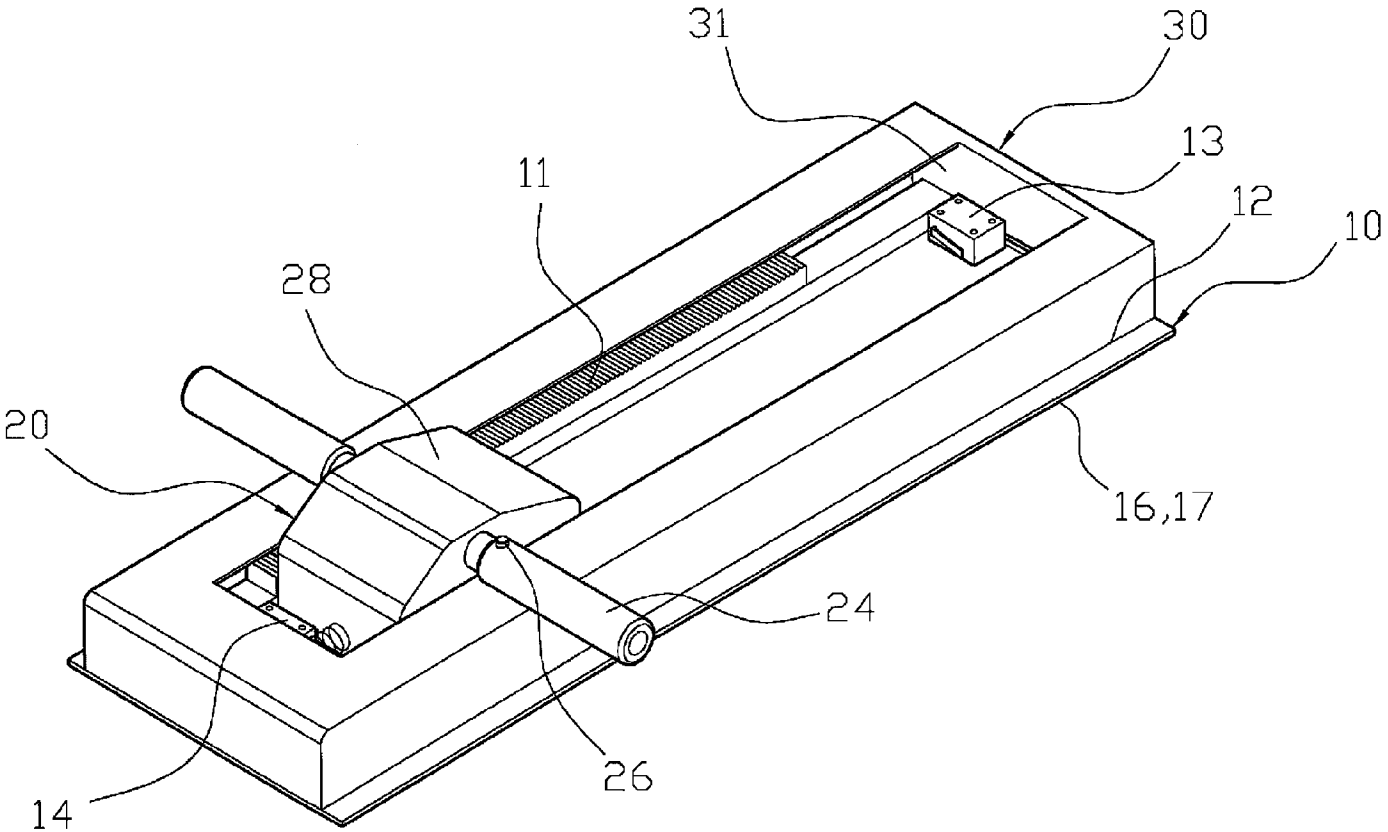
FIG. 1 is a perspective view of an exercising device in accordance with the preferred embodiment of the present invention.
Figure 2:
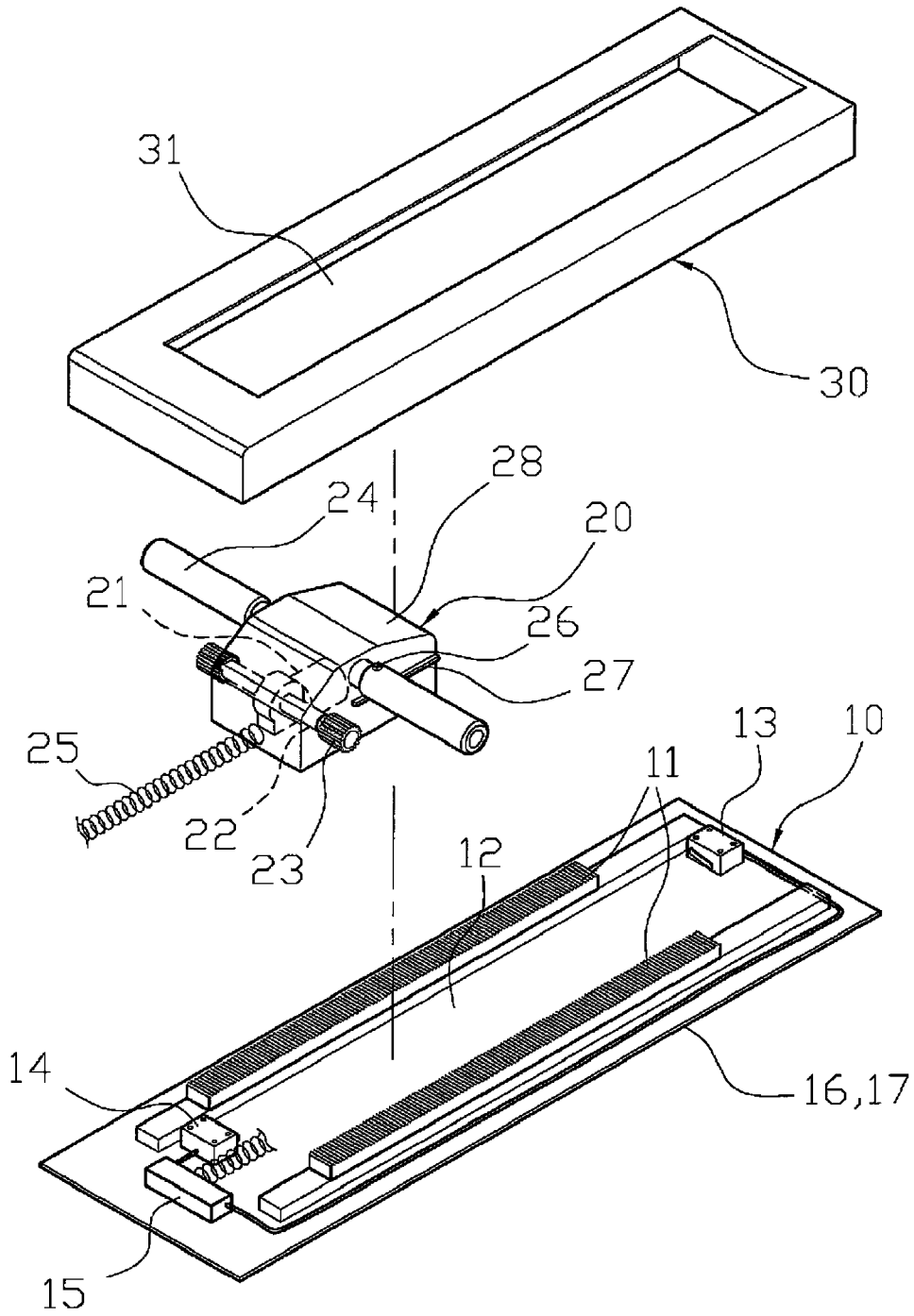
FIG. 2 is an exploded perspective view of the exercising device as shown in FIG. 1.
Figure 3:
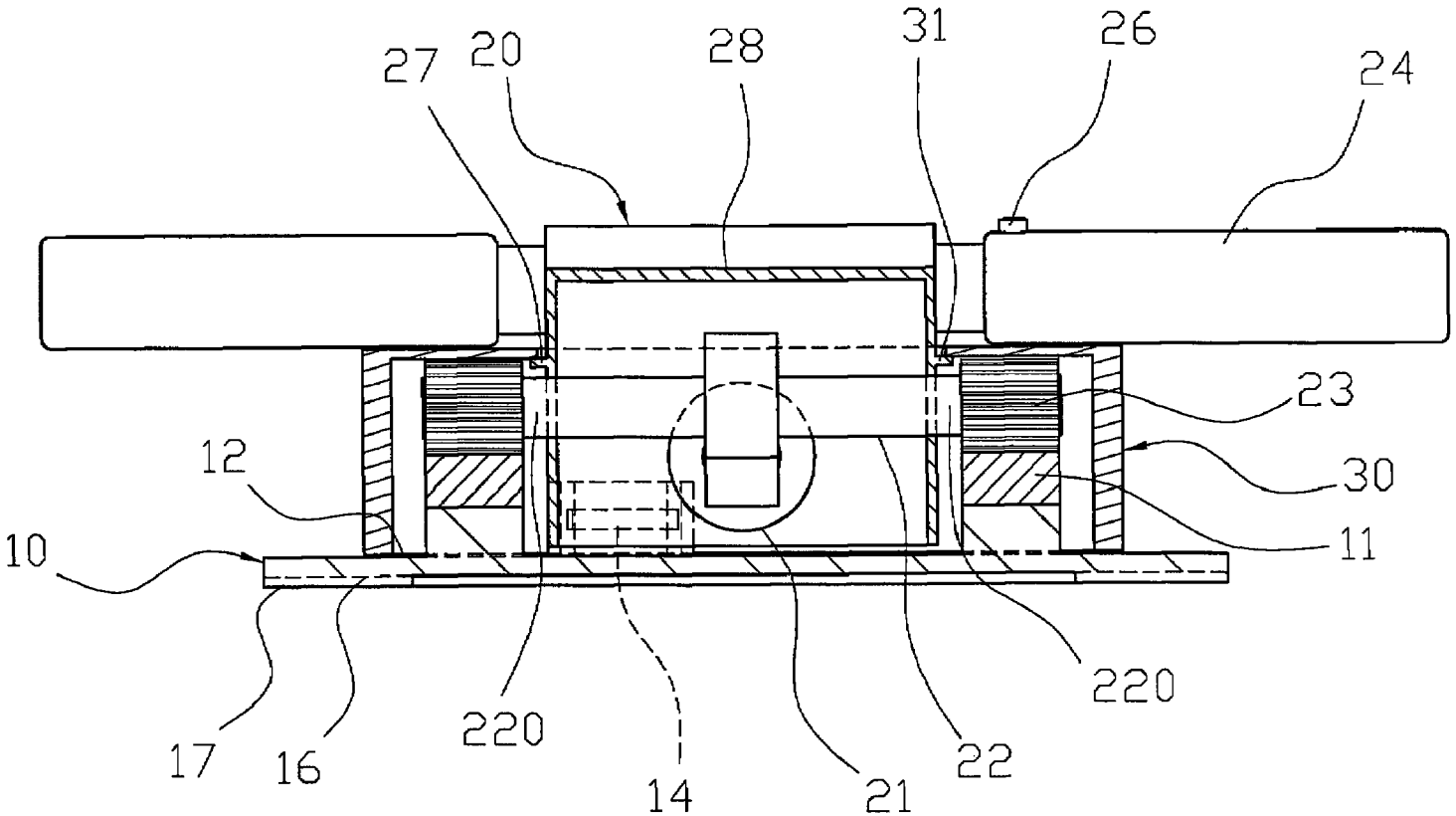
FIG. 3 is a side cross-sectional view of the exercising device as shown in FIG. 1.

Referring to the drawings and initially to FIGS. 1-3, an exercising device in accordance with the preferred embodiment of the present invention comprises a base 10, a driving unit 20 mounted on the base 10, and a limit cap 30 mounted between the base 10 and the driving unit 20 to limit the driving unit 20 onto the base 10.

The base 10 has an upper surface 12 and a lower surface 16. The upper surface 12 of the base 10 is provided with two parallel toothed racks 11, a first contact switch 13 and a second contact switch 14. Each of the toothed racks 11 has a first end a second end. The first contact switch 13 is disposed between the first ends of the toothed racks 11. The second contact switch 14 is disposed between the second ends of the toothed racks 11. The upper surface 12 of the base 10 is further provided with a controller 15 connected between the first contact switch 13 or the second contact switch 14 to receive switching signals from the first contact switch 13 or the second contact switch 14. Preferably, the toothed racks 11 of the base 10 are arranged on two shorter sides of the base 10, and the first contact switch 13 and the second contact switch 14 of the base 10 are arranged on two longer ends of the base 10.

The lower surface 16 of the base 10 is provided with an antiskid member 17. Preferably, the antiskid member 17 of the base 10 is an antiskid pad which has an endless shape and is arranged on a periphery of the lower surface 16 of the base 10. Alternatively, the antiskid member 17 of the base 10 is an antiskid pad which has a planar shape and covers the lower surface 16 of the base 10 completely.

The limit cap 30 is mounted on the upper surface 12 of the base 10 and has a top formed with an elongate slideway 31 to allow a sliding movement of the driving unit 20. The limit cap 30 has two flexible catch pieces (not shown) which are arranged on the slideway 31 to cover the slideway 31 or to open the driving unit 20 by the resilience of each of the two flexible catch pieces.

The driving unit 20 is mounted on the upper surface 12 of the base 10 and includes a housing 28 slidably mounted in and guided by the slideway 31 of the limit cap 30, a rotation shaft 22 rotatably mounted on the housing 28 and having two opposite ends 220 protruded outward from the housing 28 respectively, a motor 21 mounted in the housing 28 and connected with the rotation shaft 22 to rotate the rotation shaft 22, two driven gears 23 mounted on and rotated by the two opposite ends 220 of the rotation shaft 22 respectively and meshing with the toothed racks 11 of the base 10 respectively, two handgrips 24 mounted on the housing 28 to move in concert with the housing 28 and protruded outward from the slideway 31 of the limit cap 30, a control switch 26 mounted on one of the two handgrips 24 and electrically connected with the motor 21 to turn on/off the motor 21, an electric wire 25 electrically connected with the motor 21 and a power supply (not shown) to supply an electric power to the motor 21, and two elongate limit flanges 27 mounted on two opposite sides of the housing 28 respectively and abutting a wall of the slideway 31 of the limit cap 30.

Each of the two limit flanges 27 of the driving unit 20 is located under the slideway 31 of the limit cap 30 and is disposed between each of the two handgrips 24 and each of the driven gears 23 of the driving unit 20 to space the limit cap 30 from the driven gears 23 of the driving unit 20 so as to prevent the limit cap 30 from touching the driven gears 23 of the driving unit 20 and to limit the housing 28 of the driving unit 20 onto the limit cap 30. Each of the driven gears 23 of the driving unit 20 is located under and fully hidden in the limit cap 30. Each of the two handgrips 24 of the driving unit 20 is parallel with the rotation shaft 22 of the driving unit 20. The motor 21 of the driving unit 20 is electrically connected with the controller 15 of the base 10. The housing 28 of the driving unit 20 is partially received in the limit cap 30 and partially protrudes outward from the slideway 31 of the limit cap 30.

When in use, the driven gears 23 of the driving unit 20 mesh with the toothed racks 11 of the base 10 respectively, so that when the rotation shaft 22 of the driving unit 20 is rotated by the motor 21 of the driving unit 20, the driven gears 23 of the driving unit 20 are rotated and moved on the toothed racks 11 of the base 10 respectively to move the housing 28 and the handgrips 24 of the driving unit 20 relative to the base 10 and the limit cap 30. Thus, when the driving unit 20 touches the first contact switch 13 or the second contact switch 14 of the base 10, the motor 21 of the driving unit 20 is controlled by the first contact switch 13 or the second contact switch 14 of the base 10 to change the rotation direction of the rotation shaft 22 of the driving unit 20. In addition, the controller 15 receives the switching signals from the first contact switch 13 or the second contact switch 14 to change the rotation direction of the motor 21 of the driving unit 20.

Figure 4:
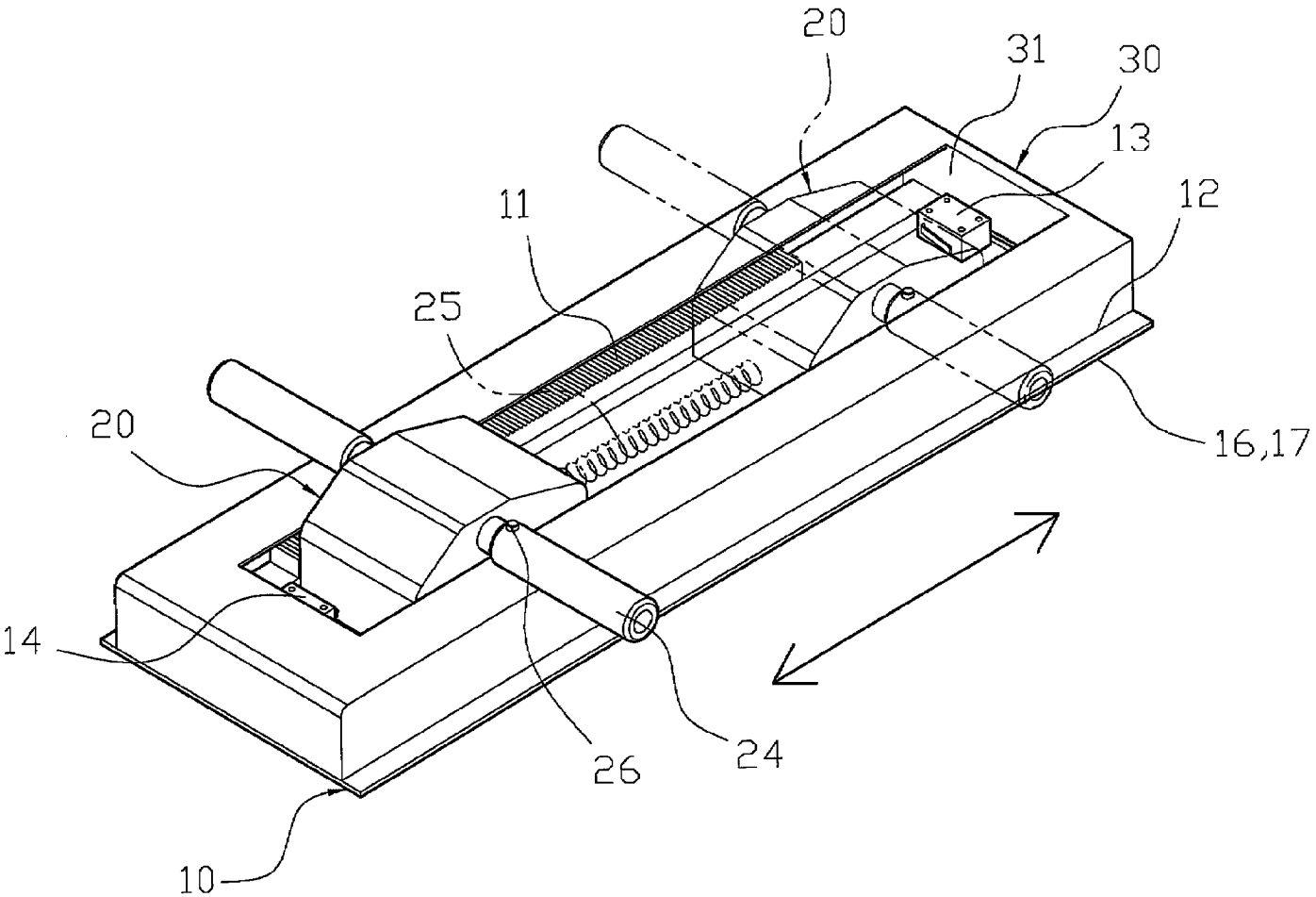
FIG. 4 is a schematic operational view of the exercising device as shown in FIG. 1 in use.
Figure 5:
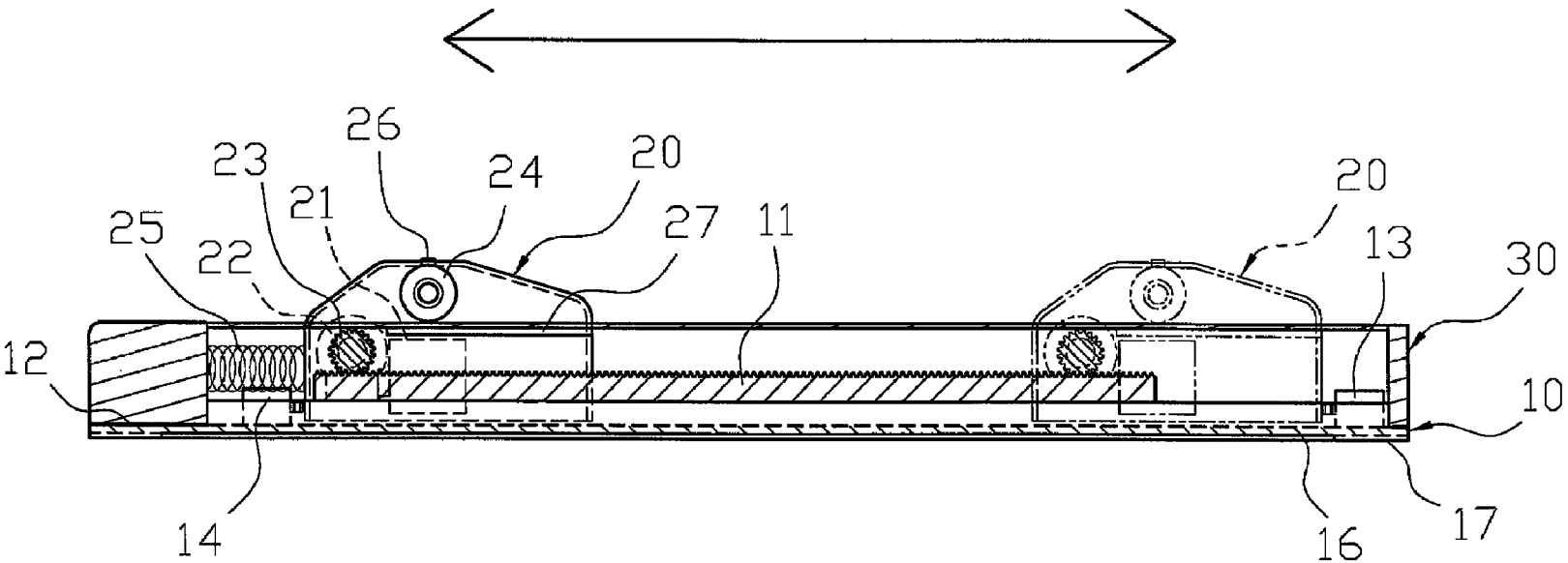
FIG. 5 is a front cross-sectional view of the exercising device as shown in FIG. 4.

In operation, referring to FIGS. 4 and 5 with reference to FIGS. 1-3, when the control switch 26 of the driving unit 20 is pressed, the motor 21 of the driving unit 20 is started to rotate the rotation shaft 22 which rotates the driven gears 23 which are rotated and moved on the toothed racks 11 of the base 10 respectively to move the housing 28 of the driving unit 20 relative to the base 10 so that the driving unit 20 is moved relative to the base 10. In such a manner, when the driving unit 20 is moved forward relative to the base 10 until the driving unit 20 touches the first contact switch 13 of the base 10, the first contact switch 13 of the base 10 produces a switching signal to the controller 15 which changes the rotation direction of the motor 21 of the driving unit 20 in an electro-control manner so that the motor 21 of the driving unit 20 is rotated in the opposite direction, and the driving unit 20 is moved backward relative to the base 10. On the contrary, when the driving unit 20 is moved backward relative to the base 10 until the driving unit 20 touches the second contact switch 14 of the base 10, the second contact switch 14 of the base 10 produces a switching signal to the controller 15 which changes the rotation direction of the motor 21 of the driving unit 20 in an electro-control manner so that the motor 21 of the driving unit 20 is rotated in the positive direction, and the driving unit 20 is moved forward relative to the base 10 again. Thus, the driving unit 20 is moved forward and backward relative to the base 10 successively as shown in FIGS. 4 and 5 so that the handgrips 24 are driven by operation of the motor 21 to move relative to the base 10 so as to perform a passive reciprocating motion.

Figure 6:
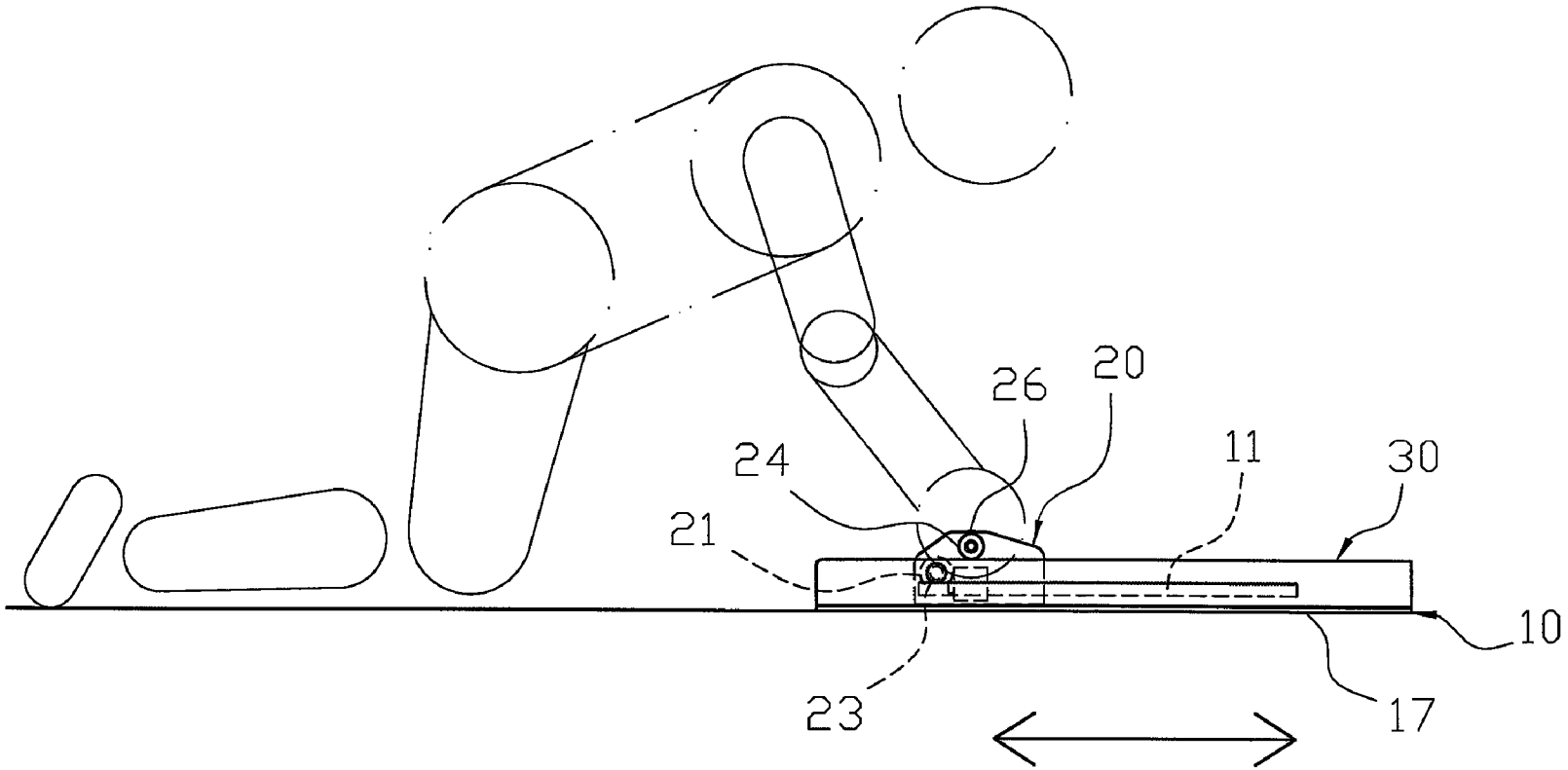
FIG. 6 is a schematic front operational view of the exercising device as shown in FIG. 1 in use.

Referring to FIG. 6 with reference to FIGS. 1-5, the base 10 is mounted on the ground so that a user is knelt on the ground with his two hands holding the handgrips 24 of the driving unit 20. Thus, the handgrips 24 are driven by operation of the motor 21 to move relative to the base 10 so as to perform a reciprocating motion so that the user is driven by the handgrips 24 to move forward and backward relative to the base 10 successively so as to exercise his arms, shoulder, chest and waist efficiently. In addition, the user performs the exercising action at a passive motion state so that the user can co-operate with the exercising device easily without incurring any difficulty.

Figure 7:
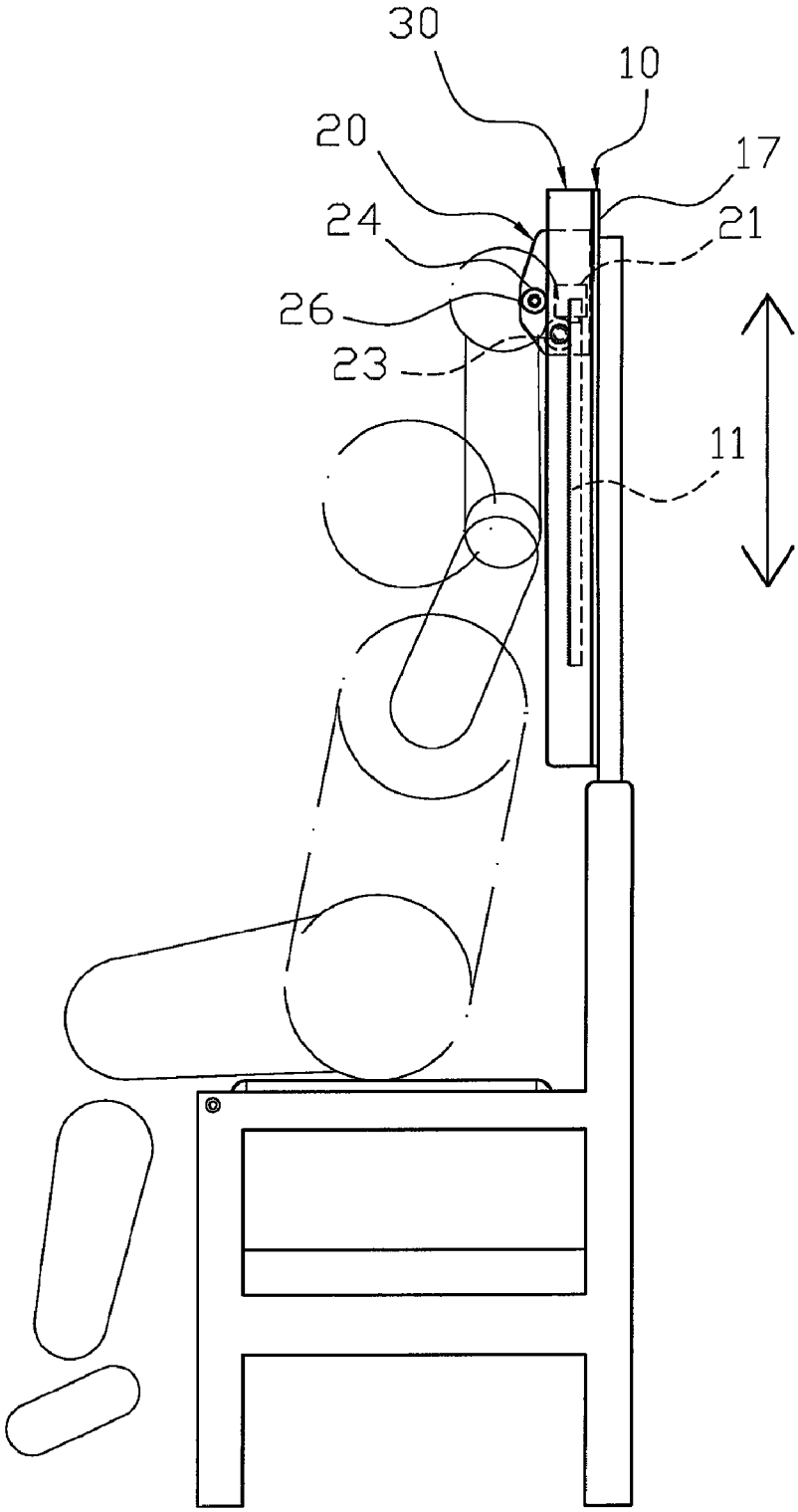
FIG. 7 is a schematic front operational view of the exercising device as shown in FIG. 1 in use.
Figure 8:
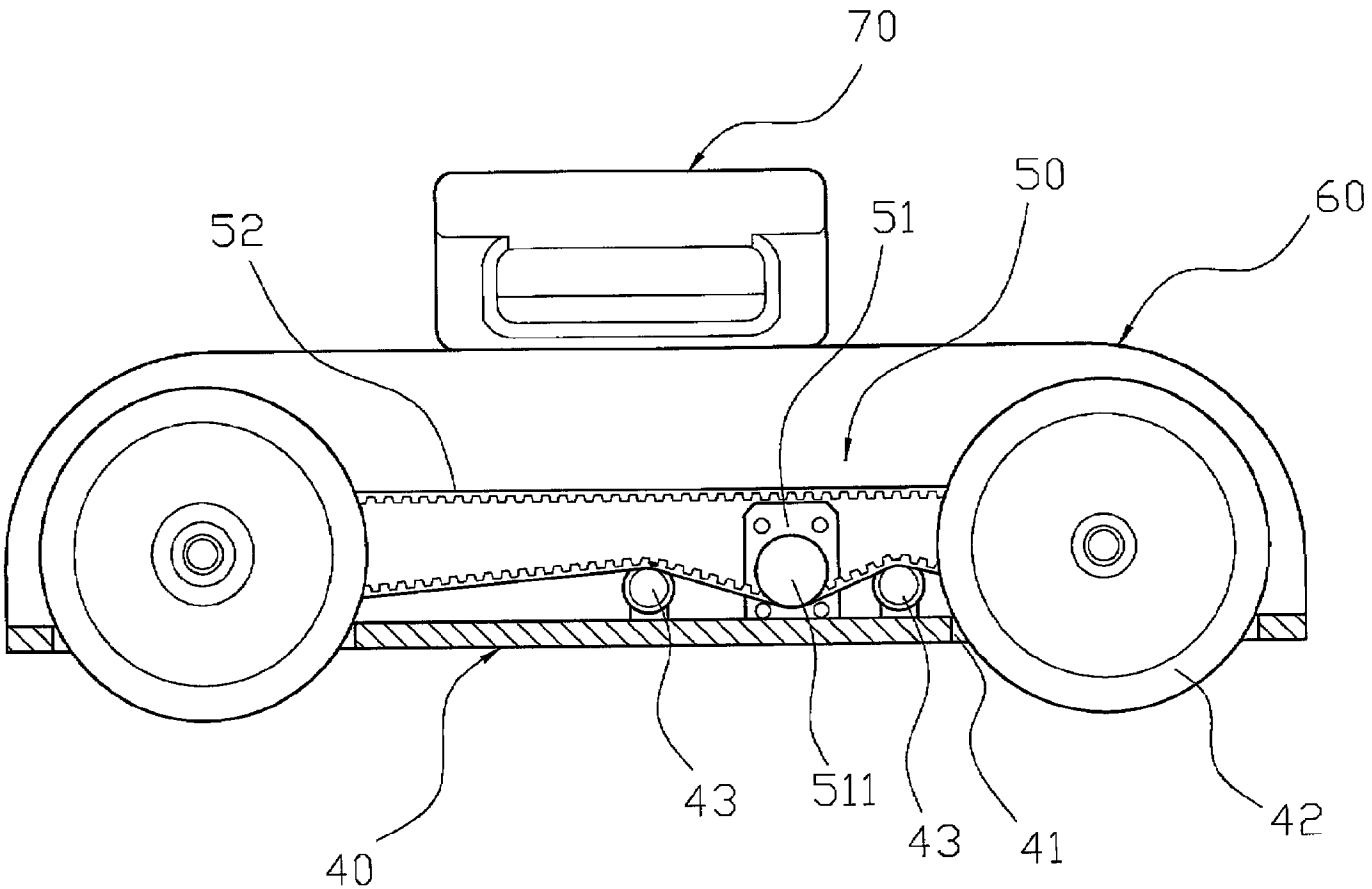
FIG. 8 PRIOR ART
FIG. 8 is a front cross-sectional view of a conventional exercising device in accordance with the prior art.
Figure 9:
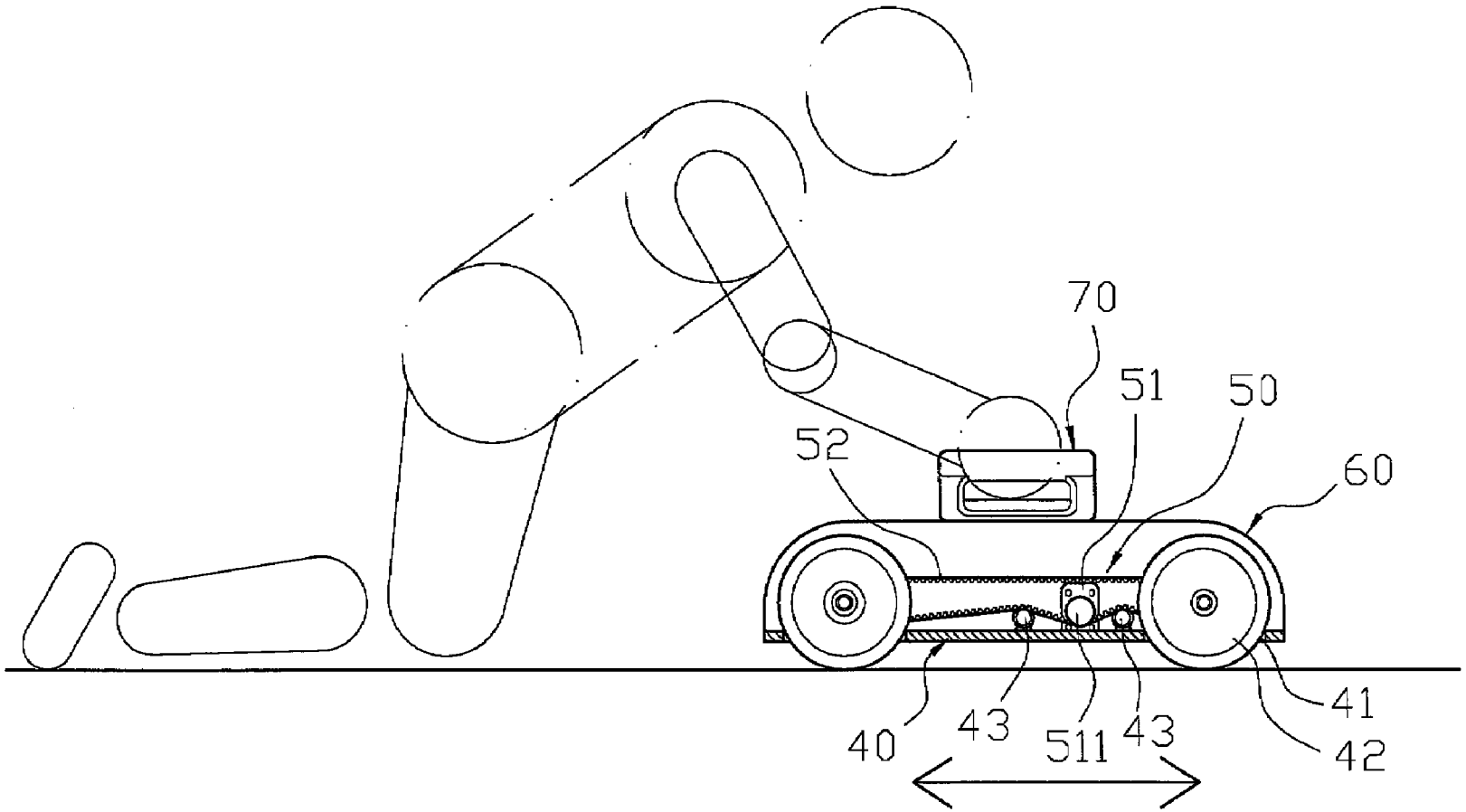
FIG. 9 PRIOR ART
FIG. 9 is a schematic operational view of the conventional exercising device as shown in FIG. 8 in use.

Referring to FIG. 7 with reference to FIGS. 1-5, the base 10 is mounted on the backrest of a chair so that a user is seated on the chair with his two hands holding the handgrips 24 of the driving unit 20. Thus, the handgrips 24 are driven by operation of the motor 21 to move relative to the base 10 so as to perform a reciprocating motion so that the user is driven by the handgrips 24 to move upward and downward relative to the base 10 successively so as to exercise his arms, shoulder, and back efficiently.

Accordingly, the slideway 31 of the limit cap 30 can guide and limit the moving direction of the driving unit 20 to prevent the driving unit 20 from being deflected sideward during movement so that the handgrips 24 are moved smoothly and stably to facilitate the user exercising his body. In addition, the driven gears 23 engage the toothed racks 11 exactly so that the driving unit 20 is moved on the base 10 smoothly and stably. Further, the driven gears 23 are supported by the toothed racks 11, and the driving unit 20 is supported by the base 10 so that the driving unit 20 has a larger strength to bear a larger pressure. Further, the antiskid member 17 of the base 10 is placed on the ground so that the base 10 will not slip from the ground to ensure the user's safety.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

The invention claimed is:

1. An exercising device, comprising:

a base;

a driving unit mounted on the base; and a limit cap mounted between the base and the driving unit to limit the driving unit onto the base;

the base has an upper surface and a lower surface;

the upper surface of the base is provided with two parallel toothed racks, a first contact switch and a second contact switch;

each of the toothed racks has a first end a second end;

the first contact switch is disposed between the first ends of the toothed racks;

the second contact switch is disposed between the second ends of the toothed racks;

the lower surface of the base is provided with an antiskid member;

the limit cap is mounted on the upper surface of the base and has a top formed with an elongate slideway to allow a sliding movement of the driving unit;

the driving unit is mounted on the upper surface of the base and includes:

a housing slidably mounted in and guided by the slideway of the limit cap;

a rotation shaft rotatably mounted on the housing and having two opposite ends protruded outward from the housing respectively;

a motor mounted in the housing and connected with the rotation shaft to rotate the rotation shaft;

two driven gears mounted on and rotated by the two opposite ends of the rotation shaft respectively and meshing with the toothed racks of the base respectively;

two handgrips mounted on the housing to move in concert with the housing and protruded outward from the slideway of the limit cap; and a control switch mounted on one of the two handgrips and electrically connected with the motor to turn on/off the motor;

each of the two handgrips of the driving unit is parallel with the rotation shaft of the driving unit;

when the driving unit touches the first contact switch or the second contact switch of the base, the motor of the driving unit is controlled by the first contact switch or the second contact switch of the base to change a rotation direction of the rotation shaft of the driving unit.

2. The exercising device of claim 1, wherein the antiskid member of the base is an antiskid pad which has an endless shape and is arranged on a periphery of the lower surface of the base.

3. The exercising device of claim 1, wherein the antiskid member of the base is an antiskid pad which has a planar shape and covers the lower surface of the base completely.

4. The exercising device of claim 1, wherein the driving unit further includes:

an electric wire electrically connected with the motor to supply an electric power to the motor.

5. The exercising device of claim 1, wherein the upper surface of the base is further provided with a controller connected between the first contact switch or the second contact switch to receive switching signals from the first contact switch or the second contact switch;

the motor of the driving unit is electrically connected with the controller of the base;

the controller receives the switching signals from the first contact switch or the second contact switch to change a rotation direction of the motor of the driving unit.

6. The exercising device of claim 1, wherein the limit cap has two flexible catch pieces which are arranged on the slideway to cover the slideway or to open the driving unit by the resilience of each of the two flexible catch pieces;

the housing of the driving unit is partially received in the limit cap and partially protrudes outward from the slideway of the limit cap;

the toothed racks of the base are arranged on two shorter sides of the base;

the first contact switch and the second contact switch of the base are arranged on two longer ends of the base.

7. The exercising device of claim 1, wherein the driving unit further includes:

two elongate limit flanges mounted on two opposite sides of the housing respectively and abutting a wall of the slideway of the limit cap;

each of the two limit flanges of the driving unit is located under the slideway of the limit cap and is disposed between each of the two handgrips and each of the driven gears of the driving unit to space the limit cap from the driven gears of the driving unit;

each of the driven gears of the driving unit is located under and fully hidden in the limit cap.

* * * * *